US011011857B2

(12) United States Patent
Walter

(10) Patent No.: US 11,011,857 B2
(45) Date of Patent: May 18, 2021

(54) WIRE TERMINATION USING FIXTURING ELEMENTS

(71) Applicants: ADVANCED BIONICS AG, Staefa (CH); Jeryle Walter, Valencia, CA (US)

(72) Inventor: Jeryle Walter, Valencia, CA (US)

(73) Assignee: Advanced Bionics AG, Staefa (CH)

( * ) Notice: Subject to any disclaimer, the term of this patent is extended or adjusted under 35 U.S.C. 154(b) by 767 days.

(21) Appl. No.: 14/768,220

(22) PCT Filed: Feb. 20, 2013

(86) PCT No.: PCT/US2013/026858

§ 371 (c)(1),
(2) Date: Aug. 15, 2015

(87) PCT Pub. No.: WO2014/130022

PCT Pub. Date: Aug. 28, 2014

(65) Prior Publication Data

US 2015/0380833 A1 Dec. 31, 2015

(51) Int. Cl.
*H01R 4/02* (2006.01)
*H01R 4/48* (2006.01)
(Continued)

(52) U.S. Cl.
CPC ..... *H01R 4/023* (2013.01); *H01R 4/02* (2013.01); *H01R 4/027* (2013.01); *H01R 4/12* (2013.01); *H01R 4/16* (2013.01); *H01R 4/48* (2013.01); *H01R 4/4863* (2013.01); *H01R 4/4872* (2013.01); *H01R 43/0214* (2013.01); *H01R 43/0221* (2013.01); *H01R 43/0235* (2013.01); *H01R 43/0263* (2013.01); *H01R 2201/12* (2013.01)

(58) Field of Classification Search
CPC ..... H01R 4/02; H01R 4/023; H01R 4/027; H01R 4/16; H01R 4/4845; H01Q 9/00; H01Q 9/04; H01Q 9/30
USPC ..... 219/56, 56.1, 56.22; 343/748, 749, 750, 343/752
See application file for complete search history.

(56) References Cited

U.S. PATENT DOCUMENTS 2,078,825 A * 4/1937 Wisner ..... H01R 4/2479 174/84 S
3,066,274 A 11/1962 Ellis
(Continued)

FOREIGN PATENT DOCUMENTS

CN 2178947 Y 10/1994
CN 1396036 A 2/2003
(Continued)

*Primary Examiner* — Robert J Utama
*Assistant Examiner* — Ayub A Maye
(74) *Attorney, Agent, or Firm* — Henricks Slavin LLP

(57) ABSTRACT

A method for forming a connection between a wire and a pin includes placing a fixturing element over the pin, capturing the wire between an upper surface and a lower surface of the fixturing element, compressing the fixturing element to hold the wire around the pin and forming a fixed connection between the wire and the pin. A system for forming an electrical connection includes a pin, a fixturing element disposed around the pin, and a wire placed around pin and sandwiched between an upper surface and a lower surface of the fixturing element.

6 Claims, 10 Drawing Sheets

(51) Int. Cl.

| | |
|---|---|
| ***H01R 4/16*** | (2006.01) |
| ***H01R 43/02*** | (2006.01) |
| ***H01R 4/12*** | (2006.01) |

(56) References Cited

U.S. PATENT DOCUMENTS 3,145,068 A * 8/1964 Neale ..... H01R 4/4863 439/729
3,150,911 A * 9/1964 Matteson ..... H01R 4/4863 439/817
3,171,705 A * 3/1965 Zdanis ..... H01R 4/247 439/391
3,284,759 A * 11/1966 Buchanan ..... H01R 4/4863 439/724
3,639,978 A * 2/1972 Schurman ..... H01R 4/4863 174/261
3,657,651 A * 4/1972 Road ..... G01R 11/36 324/137
4,080,604 A * 3/1978 Wosniewski ..... H01Q 9/14 343/745
4,149,767 A * 4/1979 Dunn ..... H01R 4/2479 439/392
4,334,208 A * 6/1982 Post ..... H01F 5/04 336/192
4,706,744 A * 11/1987 Smith ..... E21B 17/023 166/65.1
5,020,214 A * 6/1991 Tsuruoka ..... G01F 1/68 29/611
5,476,398 A * 12/1995 de Givry ..... H01R 4/4863 439/83
5,497,936 A 3/1996 Vojta et al.
5,649,974 A * 7/1997 Nelson ..... A61N 1/0563 29/825
5,906,520 A * 5/1999 Frinker ..... H01R 4/4863 439/841
6,800,001 B1 10/2004 Costa
7,140,916 B2 * 11/2006 Sweetland ..... H01R 4/14 439/595
7,159,296 B2 * 1/2007 Miya ..... H02K 15/0056 242/432.6
8,380,322 B2 * 2/2013 Taeubert ..... A61N 1/05 607/115
8,408,946 B1 * 4/2013 Sochor ..... H01R 4/4863 324/755.01
2002/0009908 A1 * 1/2002 Liu ..... H01R 4/4863 439/83
2005/0284847 A1 * 12/2005 Aoyama ..... B23K 9/20 219/93
2006/0021303 A1 2/2006 Williams et al.
2010/0257983 A1 * 10/2010 Jordan ..... B26D 1/08 83/13
2011/0071610 A1 3/2011 Shao et al.

FOREIGN PATENT DOCUMENTS

| | | | |
|---|---|---|---|
| EP | 1273381 | A1 | 1/2003 |
| GB | 2263202 | A | 7/1993 |
| JP | 7029671 | A | 1/1995 |
| WO | 2011106093 | A2 | 9/2011 |

* cited by examiner

WIRE TERMINATION USING FIXTURING ELEMENTS

BACKGROUND

Wires and cables are electrically and/or mechanically connected to a variety of different anchor points. For example, a signal wire may be electrically and mechanically connected to a pin. The pin provides a mechanical anchor that resists mechanical forces applied to the wire. The pin may also serve as an electrical conductor between the wire and other electrical components. Making connections between wires and anchor points, particularly in the microscale, can be challenging for a variety of reasons. In making a microscale connection, the wires or anchor points are very small and can be easily damaged. This requires that the subassembly be discarded. Additionally, making microscale connections can be time consuming, requires a high level of skill, and expensive application-specific fixturing.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

Figure 1A:
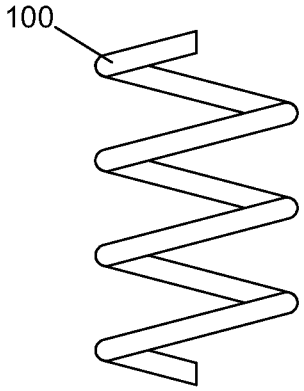
FIGS. 1A-1G show a coil that can be used to secure a wire in place near or around a pin, according to one example of principles described herein.

Implanted medical devices are typically minimum sized and use materials that are biocompatible with the implanted environment. Due to their small size and materials, implanted medical devices can require high precision parts, significant assembly time, custom fixturing, and specialized connection techniques. For example, making an electrical connection between a wire and a pin in an implanted medical device can be time consuming and expensive. Many standard wire connection techniques are not useful because of the small size or material constraints. For example, soldering may not be practicable because standard soldering materials (lead, tin, silver, etc) are not biocompatible. Further, because of the small size of the wire and anchor point (such as a pin), custom fixturing is typically used to hold the wire in place over the anchor point while the connection is made. The cost for these unique parts and the steps needed to assemble and connect them adds expense and process time.

The principles taught below describe systems and methods for using a fixturing element to attach a wire to a pin or other anchor point. These principles are applicable to a wide variety of connections and may be particularly useful in joining very small components together without reliance on complicated, high tolerance fixturing. The specific examples described below apply these principles to a connection between a wire and a pin. However, the principles can be applied to a variety of situations and geometries to mate components together without any overly complicated features and/or custom fixtures to position the parts during the assembly process.

The connection systems and methods described below relate to a coil or other fixturing element that slides over a pin. This fixturing element allows a wire to be easy placed around or near the coil and temporarily holds the wire in place until a permanent connection between the wire and the pin can be formed. The fixturing element becomes part of the permanent connection. Thus, the fixturing element serves multiple purposes: it is a simple inexpensive temporary fixturing to position the connection for welding, soldering, and brazing and provides permanent additional material for the melt and overall structure. This may be particularly useful when welding a very small diameter wire or cable.

In one implementation, the wire or braided cable is pulled tight between the turns of the coil and captured when the coil is collapsed. A resistance welder fitted with an electrode having a hole in the center goes over the pin while applying pressure to the end of the coil. The welding process fuses the parts together. The result is a self-fixtured welded assembly that does not require expensive tooling. This process does not require precise or highly toleranced mating parts. The coil, as a part of the assembly, compensates for dimensional variation in the mating components. As a result, the mating components can be fabricated using less stringent tolerances and at a lower cost. Further, the coil couples multiple components together without elaborate fixturing or touch time.

While the examples describe the connection of wires and anchor points that make up implanted devices, the principles may be applied generally to a wide variety of electrical and structural connections.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

Figure 1B:
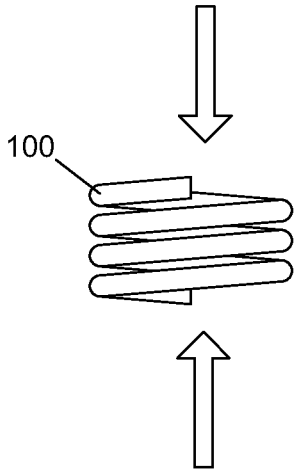

FIGS. 1A-1G show various examples of fixturing elements that have a coil configuration. The fixturing elements may be formed from a variety of materials and have different properties. FIG. 1A shows a compression coil (100) in its relaxed normally-open configuration. hi this example the coil is a helically wound, multi-turn cylindrical coil. The coil is placed over the pin and the wire is wrapped between the coils. FIG. 1B shows the same coil (100) in a compressed configuration with a compression force acting on it, shown by arrows. In its compressed configuration, the coil captures the wire or cable that is in between the coils.

Figure 1C:
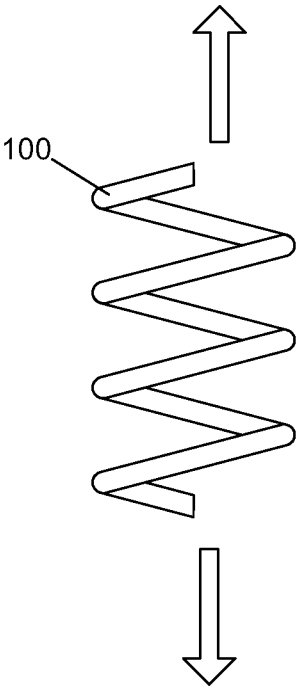
Figure 1D:
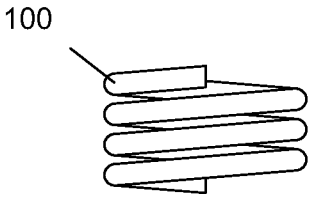

FIGS. 1C and 1D show an extension spring coil designed to resist extension of the spring. FIG. 1C shows the extension spring coil (100) in its extended configuration, being acted on by an extension force shown by arrows. FIG. 1D shows the extension spring coil (100) in its relaxed compressed configuration. When the coil (100) is extended, as in FIG. 10, a wire is inserted between the turns of the coil. The coil (100) is then allowed to relax (FIG. 1D) to sandwich the wire between adjacent turns.

Figure 1E:
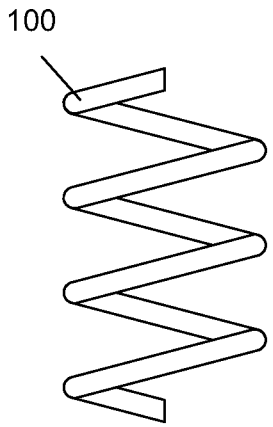
Figure 1F:
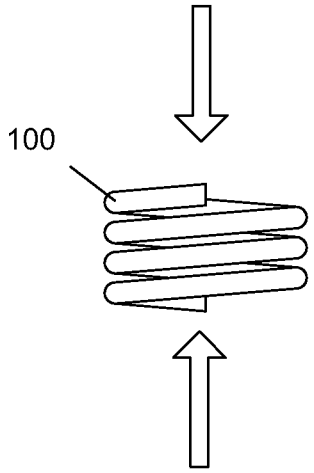
Figure 1G:
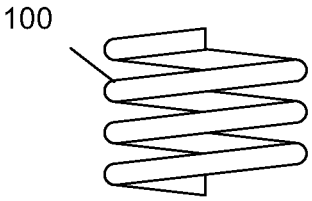

As another alternative, shown in FIGS. 1E, 1F, and 1G, the coil (100) may be formed from a plastic material or metal that does not exhibit significant resilience. The coil (100) may be open wound or may be close wound and then stretched to an open configuration as shown in FIG. 1E. FIG. 1F shows a compressive force acting on the non resilient coil (100) to compress it into a closed configuration. FIG. 1G shows the coil (100) remaining in the closed configuration after the compressive force is removed. For all of the cases described with respect to FIGS. 1A-1G, in the open configuration, there are significant gaps between adjacent turns of the coil. The height of the coil in the open configuration is significantly greater than in the closed configuration. As described below, the closed configuration holds the wire in place around the pin.

The coils described above are designed to secure a wire around a cylindrical pin. However, the coil could have a variety of different configurations to perform its function. For example, if the pin has a rectangular cross section, the coil could also be rectangular. The coil may have any number of turns. The turns may have a variety of diameters including different diameters within a single coil. The coil may be formed from a variety of materials and material conditions.

Figure 2A:
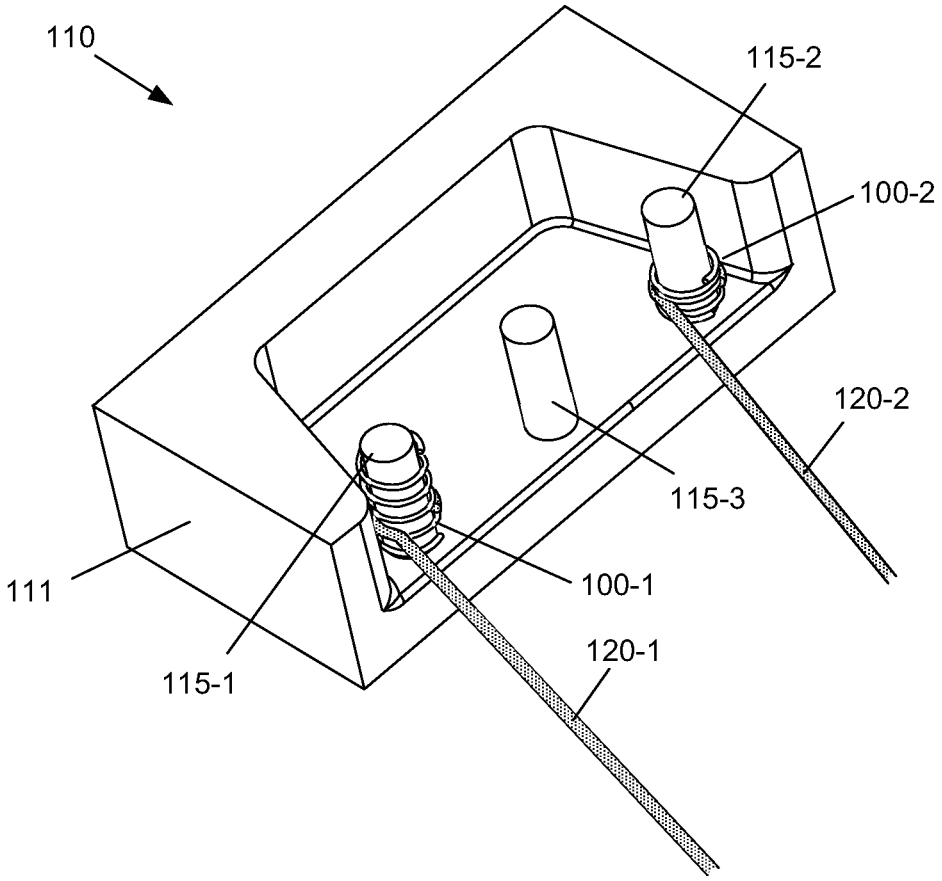
FIG. 2A is a perspective view showing coils securing wires to pins, according to one example of principles described herein.

FIG. 2A shows a terminal (110) that includes a base (111) with three pins (115). A coil (100-1) has been placed, in its open configuration, over a first pin (115-1) and a cable or wire (120-1) has been wrapped partially around the pin (115-1) and between the turns of the open coil (100-1). Another coil (100-2) is shown in its closed configuration after placing it over a second pin (115-2) with cable or wire (120-2) captured between turns of coil. The coil (100-2) secures the cable or wire (120-2) near the pin (115-2) for making a more permanent connection. Note, that if coil 100-2 is a compression spring, force is applied to continue to compress the spring, such as using a resistance welding electrode (see, e.g., FIG. 3B). The wire or cable may be wrapped around the pin or may be inserted between the coils while remaining straight.

The coils (100) could be formed from any of a number of materials depending on the application. For example, where the application is a connection of wires to a circuit board, the coil could be formed from braze materials, silver, gold, or other materials. Where the application is for a surgical implant, the coil may be formed from materials with a high level of biological compatibility, such as platinum, iridium, gold, or alloys thereof. For example, where the implant is for long term internal use, the coil and wire may be formed from platinum iridium alloys. The physical characteristics of the coil may be altered using a number of techniques, including heat treating. For example, the coil may be formed from platinum or a platinum iridium alloy and may have a range of hardnesses including an annealed dead soft state. This allows the coil to be compressed, capturing the wire or cable without any significant tendency to spring back into its previous shape. Furthermore, the pin, coil, and wire or cable may be the same or different materials.

Figure 2B:
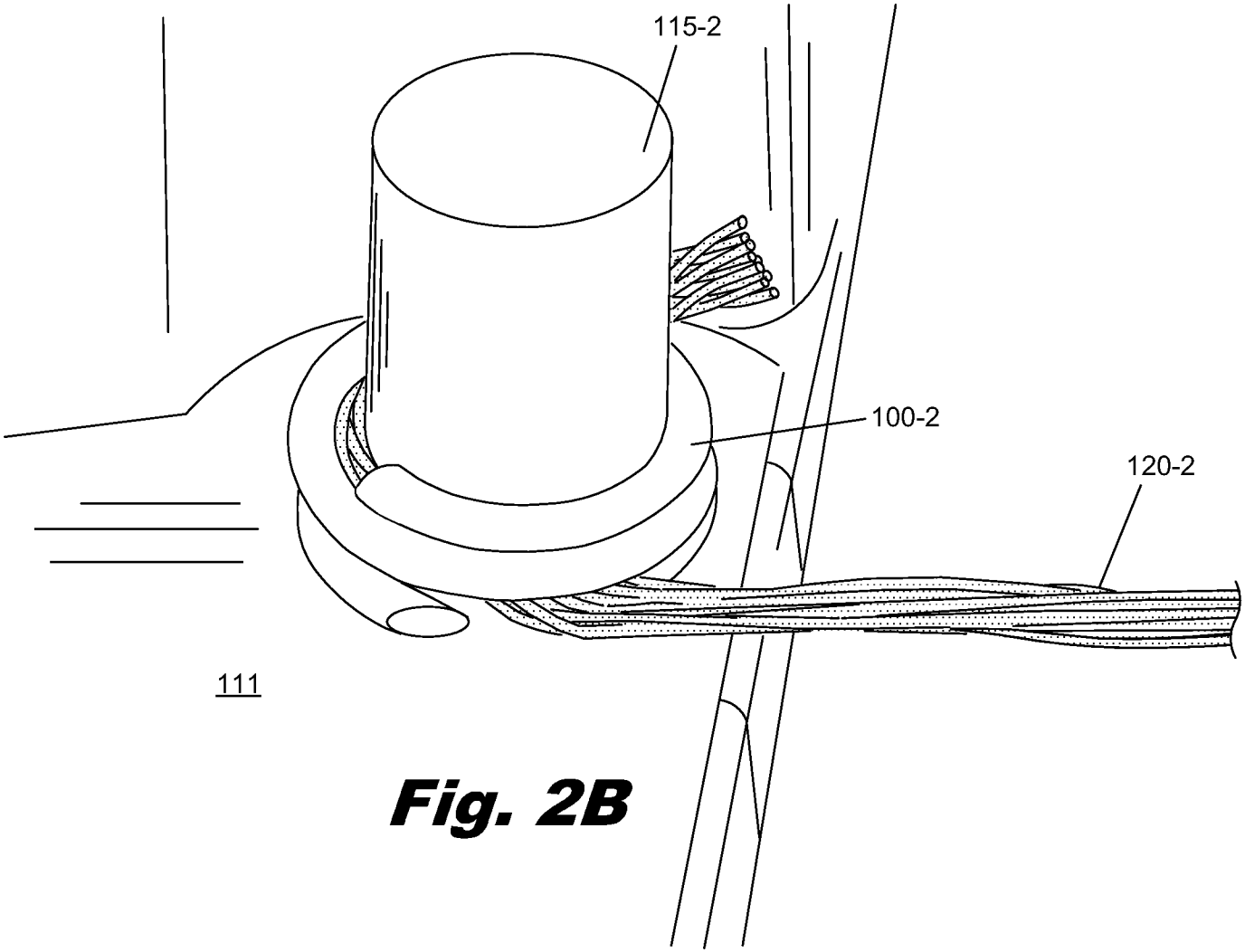
FIG. 2B is a perspective view of a coil securing a wire in place around a pin, according to one example of principles described herein.

FIG. 2B is a perspective view of a coil (100-2) securing a wire (120-2) in place around a pin (115-2). In this implementation, the pin has a diameter of approximately 700 to 800 microns and the multi-strand wire used to form the coil has a diameter of approximately 50 to 150 microns. Each strand in the multi-strand wire has a diameter of about 10 to 30 microns. The strands may be wound or woven to form the mufti-strand wire. The multi-strand wire may be formed from a platinum iridium alloy and can be coated with an insulating cover. Prior to connection to the pin, the insulating cover may be removed to allow full mechanical and electrical contact between the wire, coil, and pin.

Figure 3A:
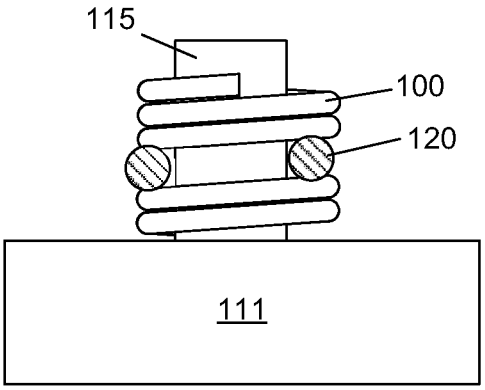
FIGS. 3A-3B are side views of steps in a method for making a connection between a wire and a pin using a coil, according to one example of principles described herein.
Figure 3B:
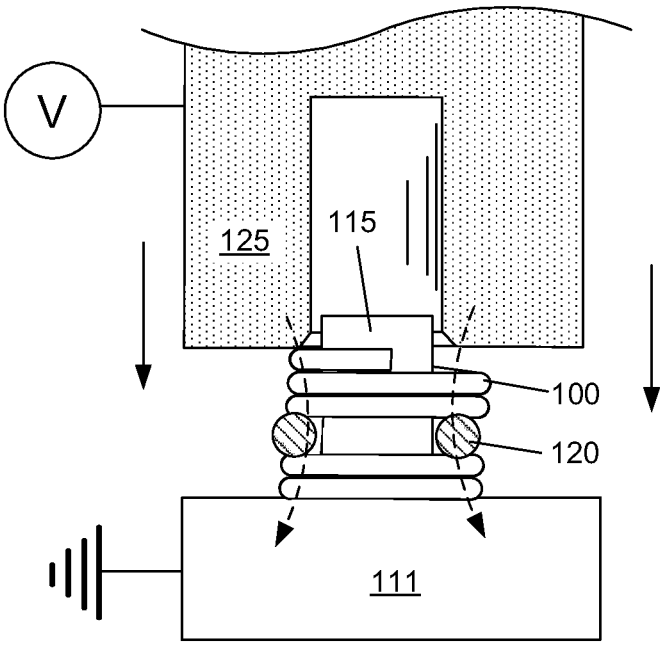

FIG. 2B shows a close up of the coil (100-2) and wire (120-2) welded to the pin (115-2) using a resistance welder (see, e.g., FIG. 3B). The resistance welder in this example produced only minimal distortion of the coil and wire. Higher currents and/or voltages may produce a welded joint with more melting.

The configuration shown in FIGS. 2A and 2B are only one example. A variety of other configurations, geometries, and materials could be used. For example, instead of multi-strand wire, a solid wire could be used. Further, the wire may be wrapped any practicable number of times around the pin.

FIGS. 3A-3B are side views showing steps in a method for making a connection between a wire (120) and a pin (115) using a coil (100). In FIGS. 3A-3B, a cross section of a solid wire (120) is shown. The coil (100) includes approximately 4 to 5 turns and fits over the pin (115). The pin (115) is secured to a base (111). FIG. 3A shows the coil (100) compressed over the solid wire (120). After the wire (120) is secured to the pin (115), a more permanent connection can be formed between the wire (120) and the pin (115) using a variety of different techniques. For example, soldering, brazing, reflowing, laser welding, and resistance welding could be used to permanently join the wire (120) to the pin (115). The coil (100) holds the wire (120) in the desired position during formation of the permanent connection. Additionally, the coil (100) may form part of the permanent connection. For example, in a resistance weld, the coil is welded to the pin and to the wire, completing the electrical circuit from the pin to the wire. For brazing operations, the surfaces of coil may create additional capillary action that encourages braze flow into and around joint.

FIG. 3B shows a permanent connection being formed using a resistance welder. In this example, a cross section of the resistance welding electrode (125) is shown. In one example, the electrode (125) has a cylindrical shape with an inner diameter that is sized to pass over the outer diameter of the pin (115). In other examples, the electrode (125) may be "U" shaped or have another geometry that fits around/over the pin (115). The electrode (125) is placed over the pin (115) and compresses the coil (100). A surge of electricity is then applied by the electrode (125) to the coil (100), pin (115) and wire (120). FIG. 3B shows a voltage V applied to the resistance welding electrode (125). The conducting base (111) is grounded so that a current (shown by the dashed arrows) passes through the coil (100), pin (115), wire (120) and into the base (111). The electricity causes resistance heating that melts the coil (100) to the wire (120) and pin (115). The base (111) in this example is a structural conductive metal such as stainless steel or titanium. Because of the large cross section of the base (111) there is minimal resistive heating in the bulk of the base (111). The principle heating occurs in proximity to the pin (115), wire (120) and coil (100). After the weld is complete the electrode (125) is then removed.

The connection can then be tested using optical inspection, making electrical resistance measurements, or performing structural tests.

The implementations given above are only examples. A variety of other connections can be formed. For example, if the pin is intended only as a mechanical anchor, the pin may not be conductive. In one implementation, the wire may serve a structural or electrical function but the pin is plastic and is intended as a strain relief anchor. The coil can be placed around the plastic pin and hold the wire in place while the pin is heat staked. Heat staking the pin causes the plastic that makes up the pin to melt and flow around/through the coil and wire, forming a fixed structural connection.

Figure 4A:
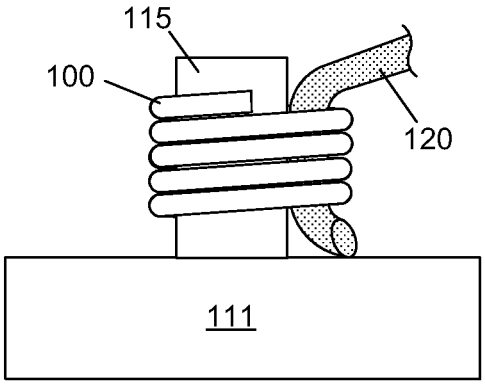
FIGS. 4A-4H show various fixturing elements being used to hold a wire around a pin, according to one example of principles described herein.
Figure 4B:
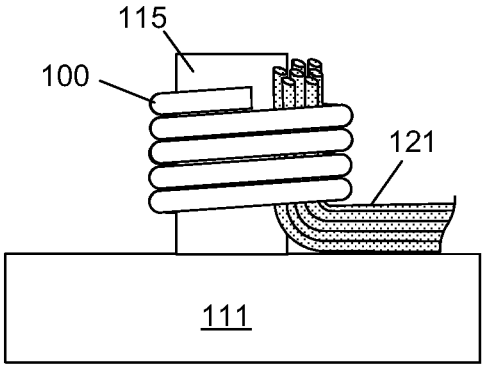

FIGS. 4A-4D are views of various alternative methods for using a coil (100) for wire termination and fixturing. In this example, the pin (115) extends upward from a base (111). However, the pin (115) and base (111) could have any of a variety of geometries and configurations. FIG. 4A shows a wire (120) placed between a coil (100) and a pin (115). The wire (120) enters the coil (100) from the top and terminates after exiting the bottom coil (100). FIG. 4B shows a stranded wire (121) entering from the opposite direction. In this case, the wire (120) enters the coil (100) from the bottom and terminates as it exits the top of the coil (100). The wires that are fixtured using a coil may be stranded, braided, or solid and may have a variety of cross sectional geometries including circular, elliptical, flat, rectangular, irregular, or other geometry.

Figure 4C:
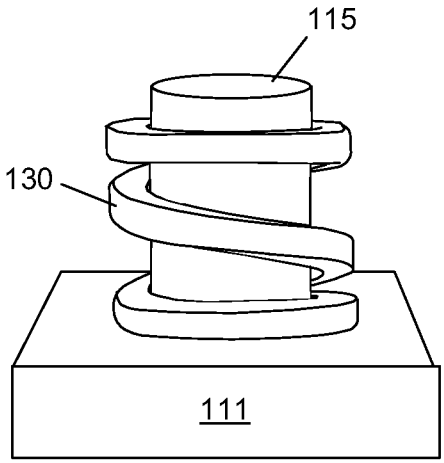
Figure 4D:
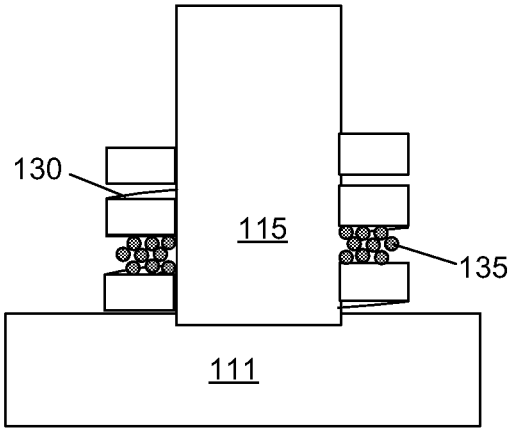

FIGS. 4C and 4D show a coil (130) that is made from a spiral of wire with a rectangular cross section. FIG. 4C shows a perspective view of the pin (115) extending upward from the base (111), with the coil (130) formed from wire with a rectangular cross section. FIG. 4D shows a cross section of the coil (130) and pin (115) with a stranded wire (135) wrapped around the pin (115) and between the coils (130). This implementation may have a number of advantages including better packing between coils (130) and more effective gripping of the wire (135).

Figure 4E:
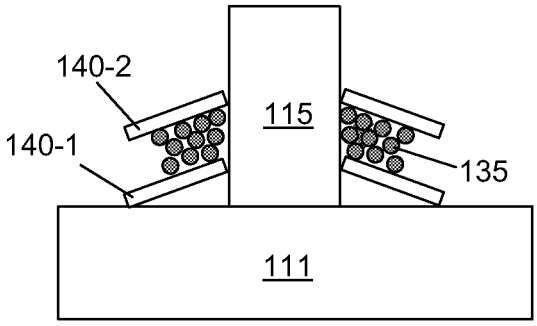
Figure 4F:
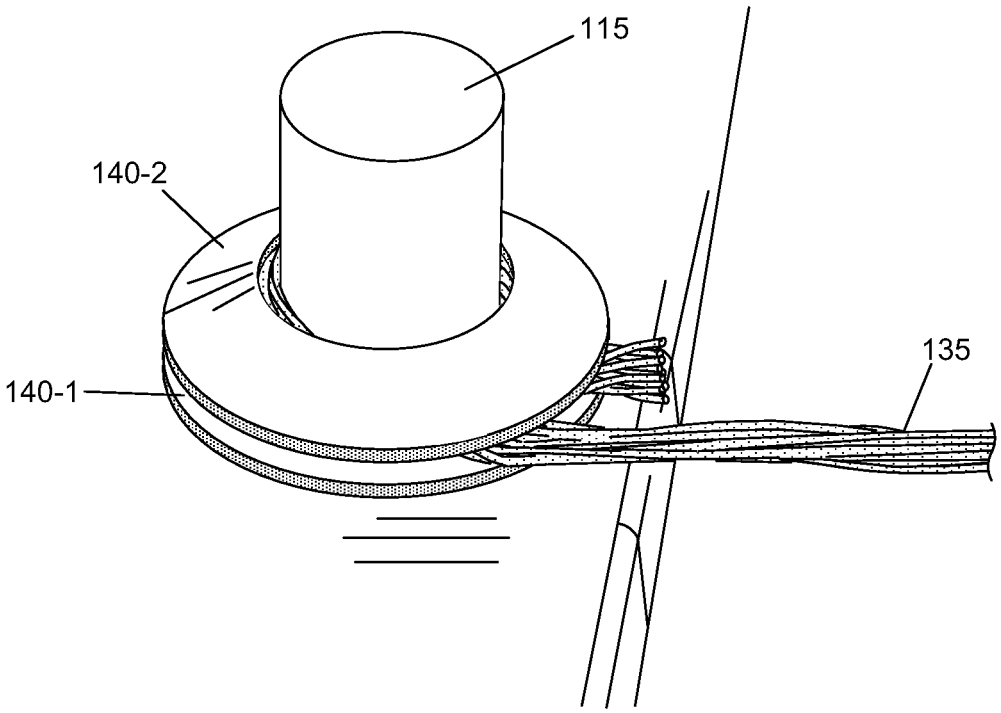

FIG. 4E shows a stranded wire (135) that loops around the pin (115) and is compressed between two Belleville washers (140). Belleville washers are a disk spring with a frustoconical shape. Belleville washers are characterized by high spring constants over a limited compression distance. To use the configuration shown in FIG. 4E, a first Belleville washer (140-1) is placed over the pin (115). The wire (135) is wrapped around the pin (115) and a second Belleville washer (140-2) is placed over the wire (135). The resistance welding head then compresses the stack before making a resistance weld that secures the washers (140) and the wire (135) to the pin (115). FIG. 4F shows a perspective view of this connection, with the stranded wire (135) wrapping clockwise around the pin (115). The wire is sandwiched between the upper surface of a first Belleville washer (140-1) and the lower surface of the second Belleville washer (140-2). A variety of other washer types could be used, including flat washers, split washers, wave washers, serrated washers, or geometries.

Figure 4G:
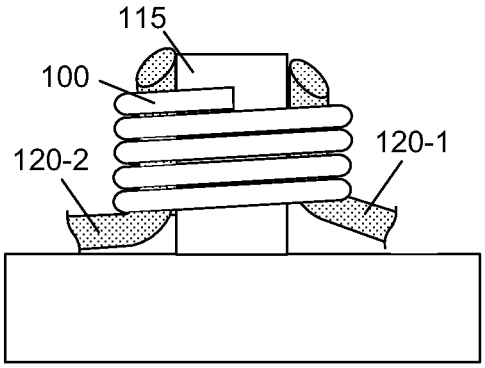

FIG. 4G is a side view of multiple wires (120-1, 120-2) that are fixtured by a coil. In this example, the wires (120) pass up through a coil (100). The coil can fixture a number of wires and allow an electrical connection to be made between the wires and the post (115). Using this technique, connections between wires may be easily and conveniently formed at an anchor point (the pin 115). This provides a number of benefits. For example, the anchor point prevents tension or thermal heating in one wire from adversely affecting the other wire(s). Any of the coils and fixturing techniques described herein can be adapted to hold multiple wires. One of the advantages of using a coil is that the same fixturing technique can be used to secure one wire, two wires, three wires or more than three wires.

Figure 4H:
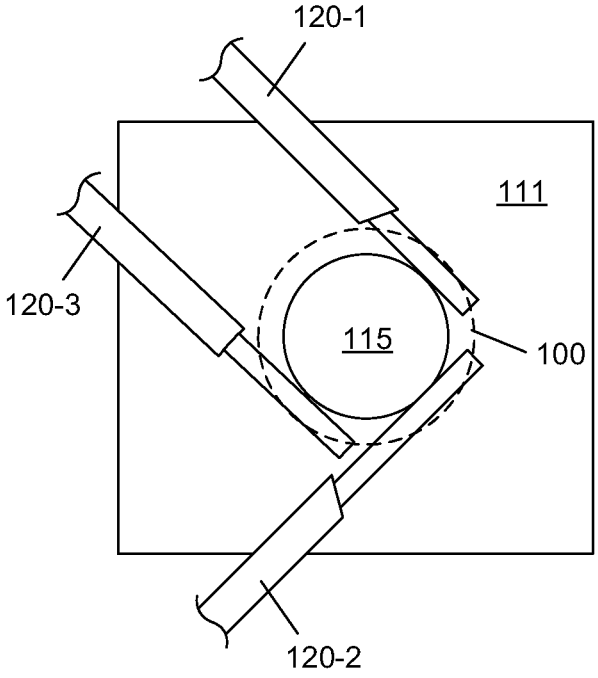

FIG. 4H is a top view of a pin (115) that extends upward from a base (111). A number of wires (120) are placed tangent to the pin (115). The wires may be under a coil (100) or between turns of the coil (100). The outer perimeter of the coil (100) is shown as a dashed line. As discussed above, the coil (100) then holds the wires in place while a permanent connection is made. This configuration has a number of advantages. For example, there is no need to form the wires (120) into a hook shape or wrap the wires around the pin (115). In contrast, the insulation (if any) can be stripped off the wires and the wires can be place tangent to the pin (115). Compared with wrapping wires, this technique reduces the chances of fracturing the wire during the bending and reduces the cost of making the connection.

In some implementations, the coil and/or wires may be specially adapted to securely fixture the wires where there is a smaller surface contact area between the wire and the coil. For example, the coil may exert greater compressive forces to more firmly grip the smaller surface area of the wire in contact with the coil. Additionally or alternatively, the coil or wire may have flat surfaces to increase the contact area. This configuration is also well adapted to connecting larger numbers of wires together.

Figure 5:
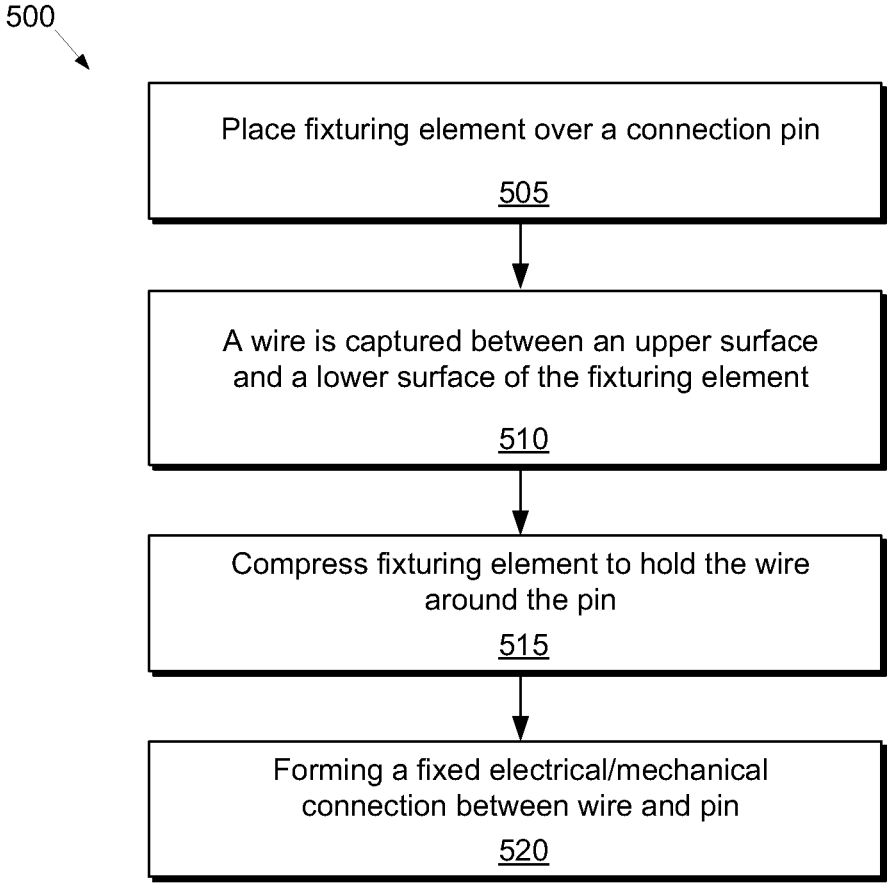
FIG. 5 is a flowchart of a method for securing a wire to a pin using a coil, according to one example of principles described herein.

FIG. 5 is a flowchart of one illustrative method (500) for securing a wire around a connection pin using a fixturing element. The fixturing element may be any of a variety of devices, including coils, springs, washers, or other elements that fit over the connection pin. In this example, the fixturing element is placed over the connection pin (step 505). For example, the fixturing element may be a coil. The inside diameter of the coil may be larger, smaller or the same as the outside diameter of the pin. Where a very snug fit is desired, the inside diameter of the coil may be significantly smaller that the outside diameter of the pin. When the coil is forced over the pin, the coil expands and may slightly uncoil.

The wire is captured between an upper surface and a lower surface of the fixturing element (step 510). For example, the upper surface may be an upper turn of a coil and the lower surface may be lower turn of the coil. Where washers are used, the upper surface of a first washer and the lower surface may be a second washer. The wire may remain straight, lying tangent to the pin. Alternatively, the wire may make a partial wind around the pin as shown in FIG. 2 or the wire may make one, two or more complete revolutions around the pin.

The fixturing element is compressed to hold the wire around the pin (step 515). In some examples, such as when using a compression spring or washers, positive pressure may be used to keep the fixturing element compressed. Alternatively, if an extension spring is used, the spring itself may provide the compression force. As discussed above, the coil may be dead soft so that it deforms when pressure is applied and remains deformed after the pressure is removed.

A fixed electrical/mechanical connection can then be made between the wire and the pin (step 520). In general, the fixed connection is a stable connection that bonds the wire to the pin. For example, the fixed connection may be a weld joint, a solder joint, a braze joint, epoxy joint, or other connection. The fixed connection may or may not be permanent. For example, a solder joint is not necessarily a permanent connection because the solder could be melted and the wire withdrawn from the connection. In contrast, a welded connection is typically viewed as a permanent connection because the wire typically cannot be removed without damage to the pin or wire.

The coil holds the wire in place during the creation of the fixed connection. For example, if the assembly needs to be moved to a different station to form the fixed connection, the coil holds the wire around the pin during the motion. As discussed above, the permanent electrical/mechanical connection can be formed in a variety of ways including the use of laser or resistance welding.

The principles described above provide a number of benefits, including using components for fixturing the wire that do not have to be highly toleranced. For example, the coil may be intentionally formed with an inner diameter that is smaller than the outer diameter of the pin. When placed over the pin the coil will adapt to the size of the pin by expanding and/or slightly uncoiling. The coils then grips the pin. The wire can be forced in between the coils or in between the pin and the wires. In some examples, the coil may be placed over the wire, the wire placed near the pin and then the coil slid down the wire and over the pin and the wire. Because the coil can readily adapt to different sized pin and wires, the tolerances of the pins and coils can be greater while still allowing a range of wire types (including dissimilar metal alloys) and diameters to be connected. This makes the connection less expensive to fabricate. Using a coil to "couple" multiple components together does not require elaborate fixturing or touch time to load into custom fixtures.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A method for forming a connection between a wire and a pin that defines longitudinal ends and an axial direction, the method comprising:

placing a coil onto and around the pin;

capturing the wire against and between first and second surfaces of the coil at a location between the longitudinal ends of the pin by compressing the coil with a welding electrode in the axial direction from an uncompressed state where the first and second surfaces are spaced apart to a compressed state where the first and second surfaces are closer to one another than they-the first and second surfaces were in the uncompressed state: and forming a weld joint between the captured wire and the pin with the welding electrode that is compressing the coil by passing current from the welding electrode through the coil, the wire and the pin to resistively heat the coil and melt the coil to the wire and the pin.

2. The method of claim 1, wherein the coil is placed over the pin in an expanded configuration.

3. The method of claim 1, wherein the coil is a multi-turn coil and wherein capturing the wire further comprises capturing the wire between turns of the coil.

4. The method of claim 1, wherein the compression in the axial direction brings at least some of the adjacent turns of the coil into direct contact with each other.

5. The method of claim 1, wherein the coil comprises a ductile metal.

6. The method of claim 1, wherein the coil comprises dead soft platinum.

* * * * *